US007331456B2

(12) United States Patent
Pengerc et al.

(10) Patent No.: US 7,331,456 B2
(45) Date of Patent: Feb. 19, 2008

(54) STORAGE CONTAINER

(75) Inventors: James E Pengerc, Parkville, MD (US); William Bredlow, Bel Air, MD (US); David L Wikle, York, PA (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/507,821

(22) Filed: Aug. 22, 2006

(65) Prior Publication Data

US 2006/0278548 A1 Dec. 14, 2006

Related U.S. Application Data

(63) Continuation of application No. 10/781,052, filed on Feb. 18, 2004, now Pat. No. 7,165,674.

(51) Int. Cl.
*B65D 85/20* (2006.01)

(52) U.S. Cl. ..... 206/379; 206/443; 206/459.5; 206/776

(58) Field of Classification Search ..... 206/214, 206/261, 368, 369, 372–379, 443, 459.5, 206/472–475, 523, 526, 527
See application file for complete search history.

(56) References Cited

U.S. PATENT DOCUMENTS

| | | | | |
|---|---|---|---|---|
| RE13,408 | E * | 4/1912 | Sine | 211/69 |
| 1,192,575 | A * | 7/1916 | Selander | 206/379 |
| 2,589,234 | A * | 3/1952 | Drohman | 206/379 |
| 4,934,530 | A * | 6/1990 | Riess | 206/379 |
| 5,732,820 | A * | 3/1998 | Tsai | 206/369 |
| 6,547,077 | B1 * | 4/2003 | Budert | 206/754 |

* cited by examiner

*Primary Examiner*—Mickey Yu
*Assistant Examiner*—Jerrold Johnson
(74) *Attorney, Agent, or Firm*—Harness, Dickey & Pierce, P.L.C.

(57) ABSTRACT

A storage container for housing drill bits can include a front housing portion and a rear housing portion. The front and rear housing portions can be pivotally connected through a hinge for moving between open and closed positions. The front and rear housing portions can define a body cavity therebetween in the closed position. A front bit holder can be pivotally connected to the hinge and lie adjacent to the front housing portion. A rear bit holder can be pivotally connected to the hinge and lie adjacent the rear housing portion. An intermediate bit holder can be pivotally connected to the hinge and lie between the front and rear bit holder.

18 Claims, 11 Drawing Sheets

STORAGE CONTAINER

CROSS-REFERENCE TO RELATED APPLICATIONS

This application is a continuation of U.S. patent application Ser. No. 10/781,052, filed on Feb. 18, 2004 now U.S. Pat. No. 7,165,654.

FIELD OF THE INVENTION

The present invention relates generally to storage containers, and more particularly to a storage container having independently hinged sleeves for retaining drill bits.

BACKGROUND

Storage containers exist in many varieties and may be used to store, organize and transport various items such as fasteners, tool bits and other accessories. Plastic storage containers can be typically manufactured fairly inexpensively, but often at the expense of being less rigid and providing less flexibility in adapting the storage container to store items of various sizes. When a storage container is used to store tool accessories such as drill bits on a job site, it is desirable for the user to be able to quickly identify and access the drill bit of interest. Sometimes however, a large collection of drill bits of random size are staggered within a storage container such that identification and access is cumbersome.

Furthermore, storage containers that incorporate organizational schemes often present the drill bits in a structured pattern such that the user may easily identify the drill bit of interest but do not allow the user convenient access to remove or replace the drill bit from its holding arrangement. In addition, a storage case must be built to be strong and durable so that if it is moved quickly or dropped, it will not allow smaller drill bits to slide out of their respective holding arrangements.

SUMMARY OF THE INVENTION

A storage container for housing drill bits according to the present teachings can include a front housing portion and a rear housing portion. The front and rear housing portions can be pivotally connected through a hinge for moving between open and closed positions. The front and rear housing portions can define a body cavity therebetween in the closed position. A front bit holder can be pivotally connected to the hinge and lie adjacent to the front housing portion. A rear bit holder can be pivotally connected to the hinge and lie adjacent the rear housing portion. An intermediate bit holder can be pivotally connected to the hinge and lie between the front and rear bit holder.

According to additional features, the front bit holder can extend upward a first distance from a bottom of the body cavity. The rear bit holder can extend upward a second distance from the bottom of the body cavity. The second distance can be greater than the first distance. The intermediate bit holder can extend upward from a bottom of the body cavity a third distance. The third distance can be less than the second distance and greater than the first distance.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
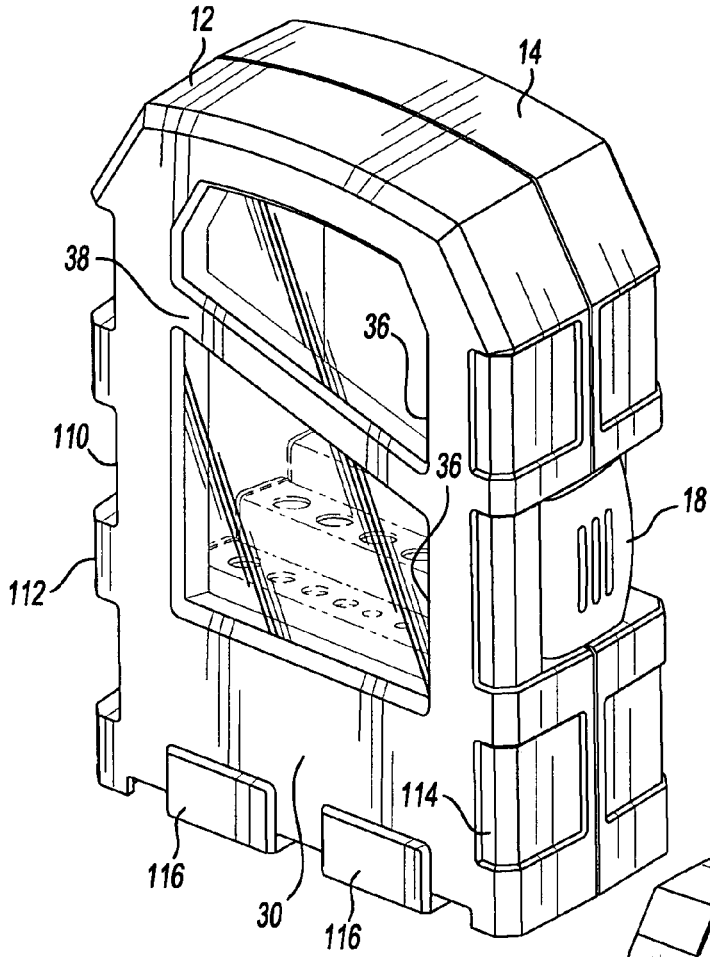
FIG. 1 is a right perspective view of the storage container constructed in accordance to the present invention shown in the closed position.
Figure 2:
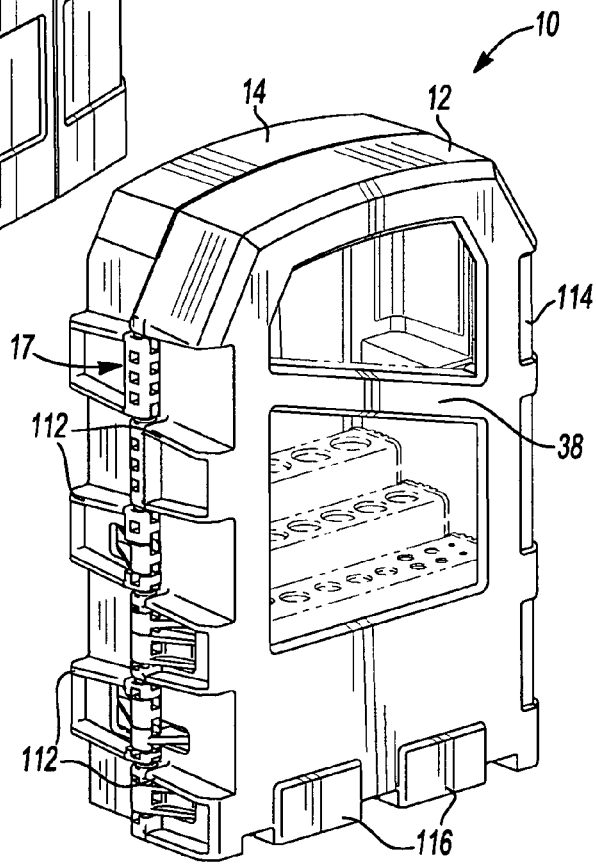
FIG. 2 is a left perspective view of the storage container.
Figure 8:
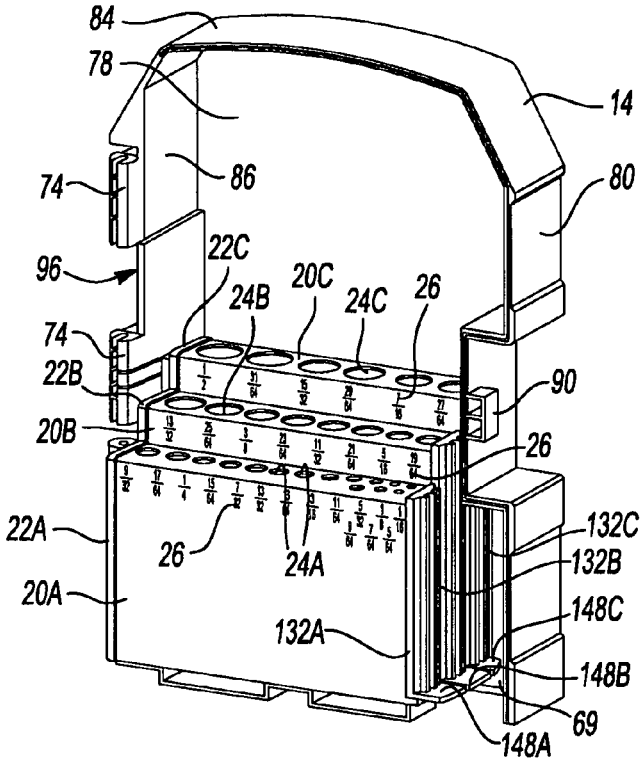
FIG. 8 is a partial front perspective view of the storage container shown with the front cover removed for illustration.
Figure 9:
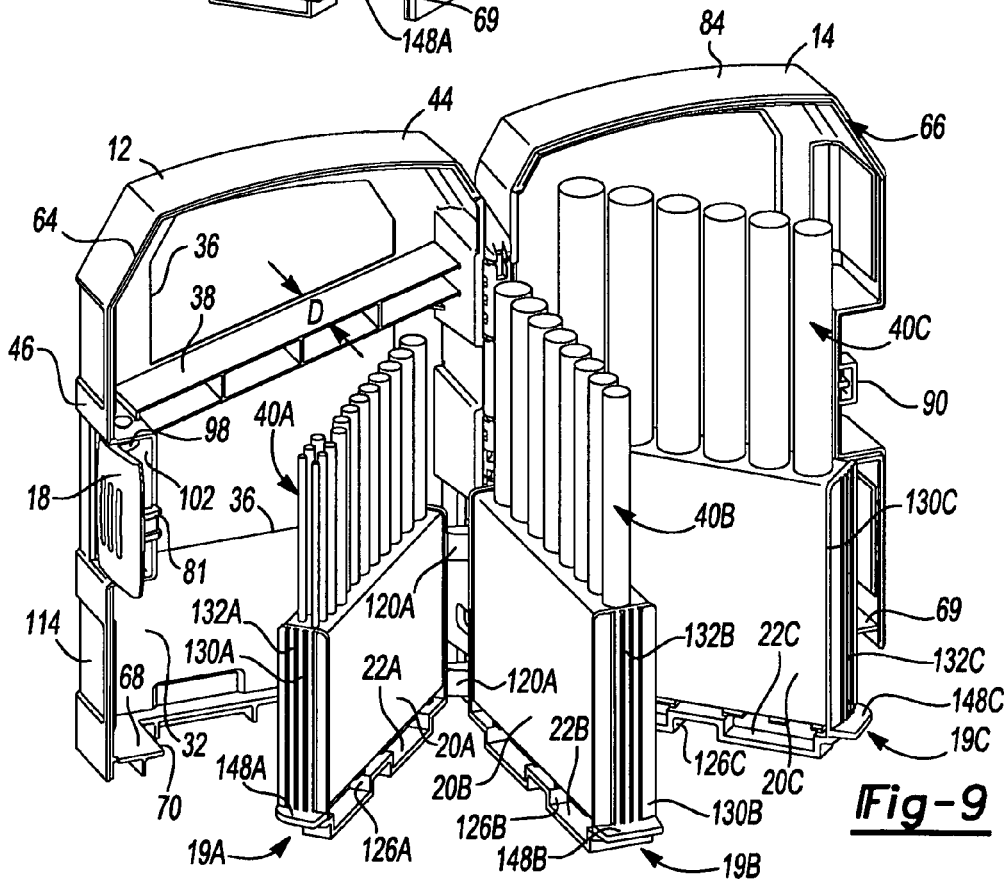
FIG. 9 is a perspective view of the storage container shown in an open position.
Figure 10A:
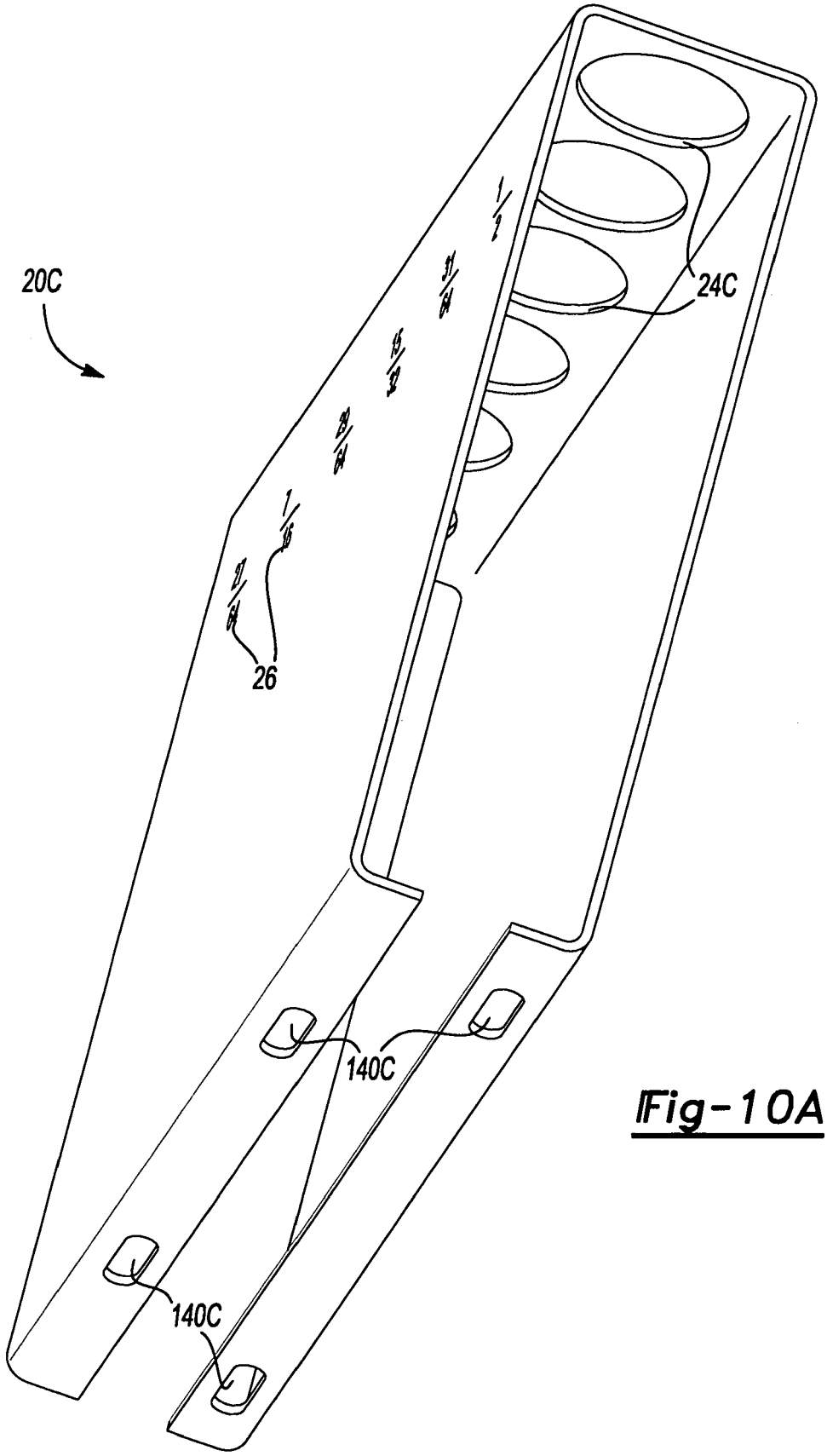
FIG. 10A is a perspective view of a first metal sleeve of the storage container.
Figure 10B:
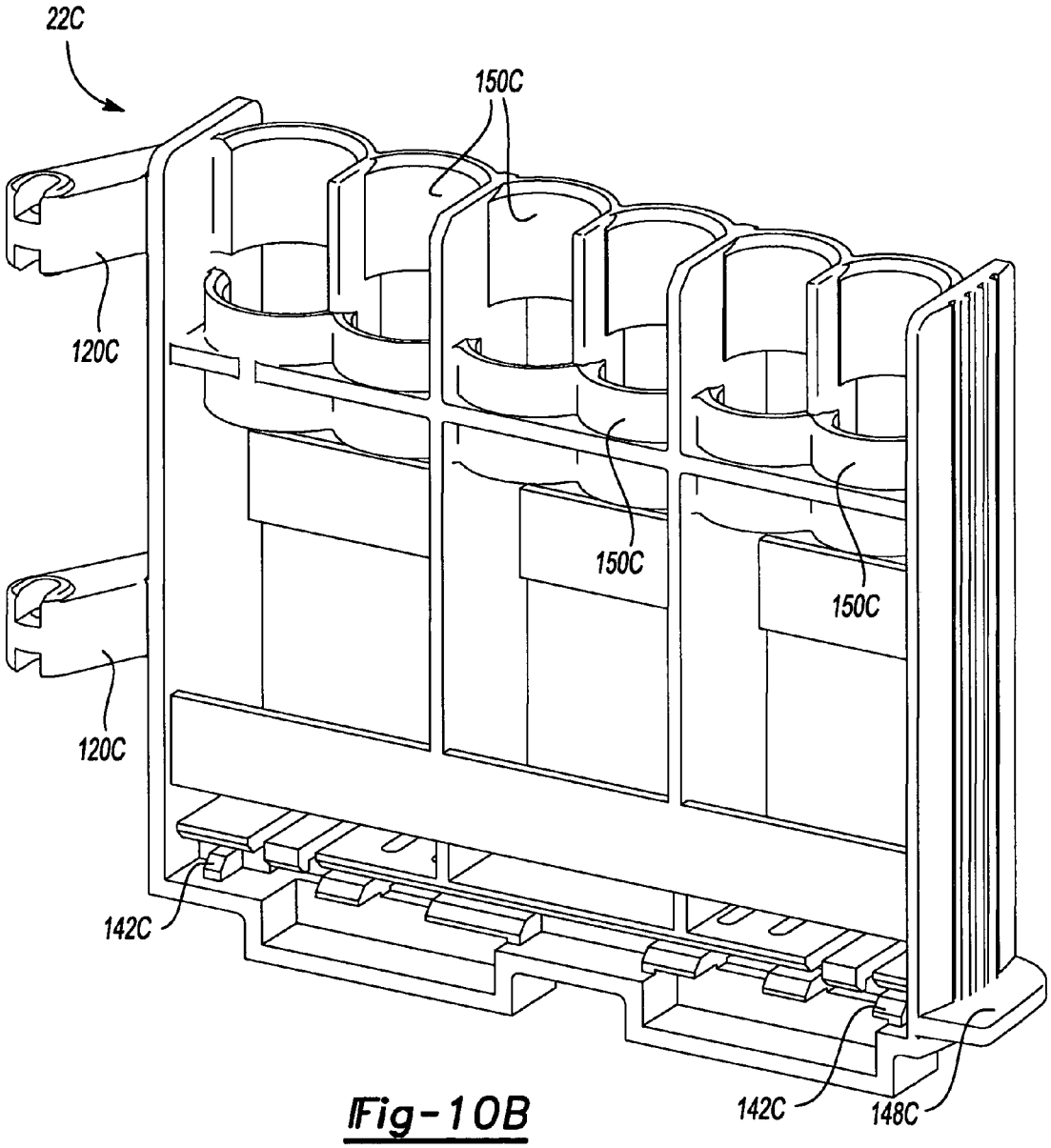
FIG. 10B is a perspective view of a first frame body portion of the storage container.
Figure 11A:
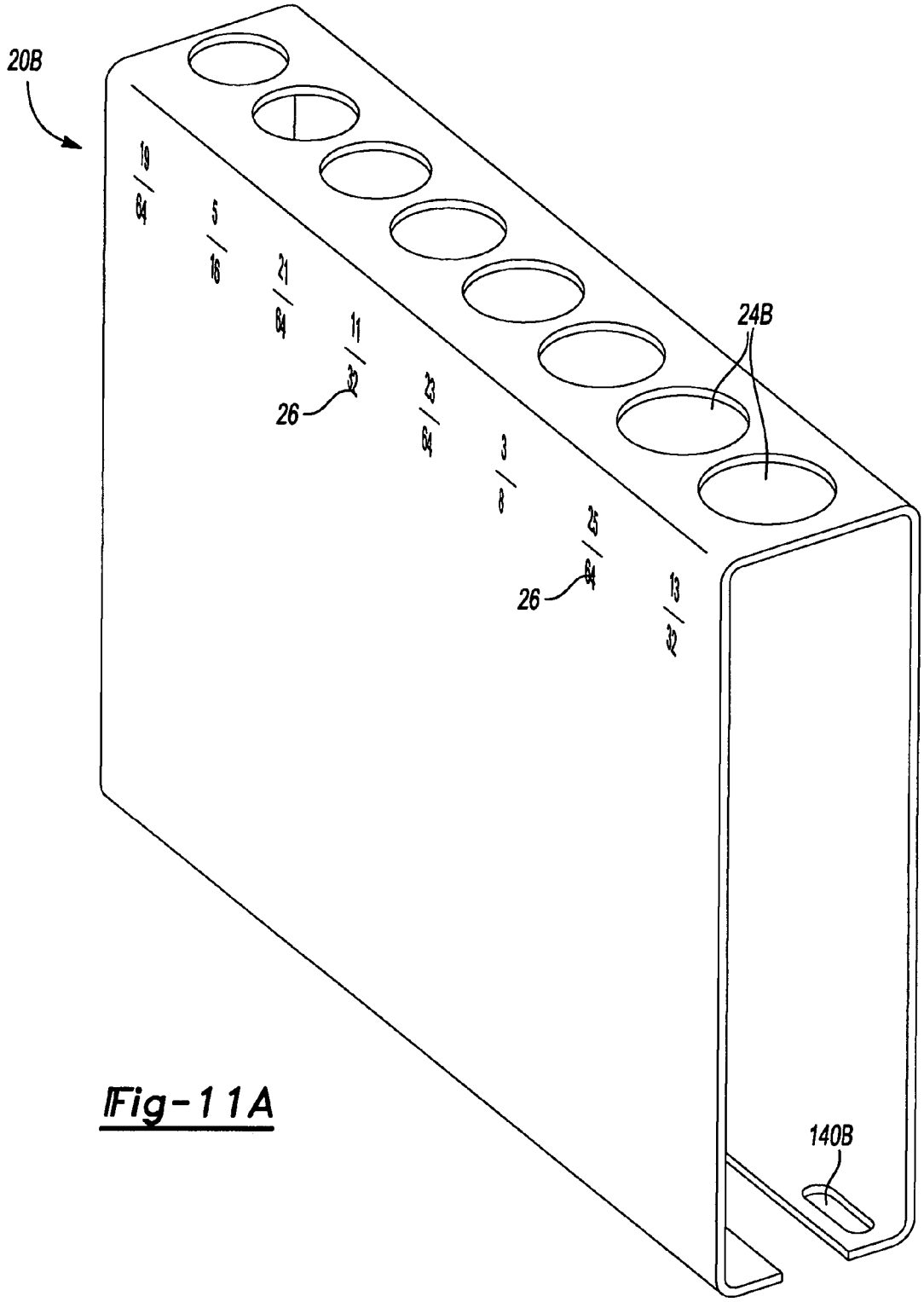
FIG. 11A is a perspective view of a second metal sleeve of the storage container.
Figure 11B:
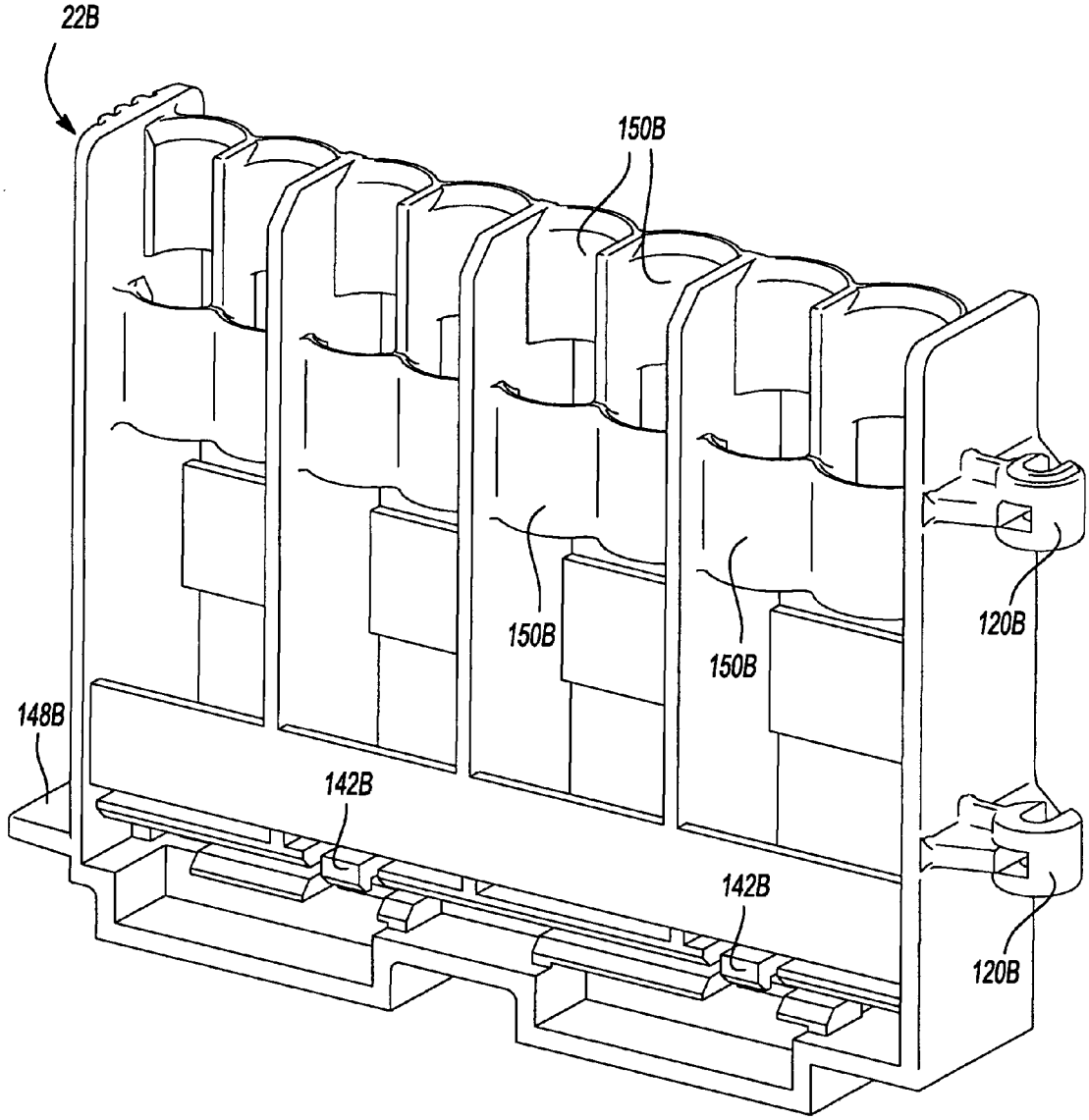
FIG. 11B is a perspective view of a second frame body portion of the storage container.
Figure 12A:
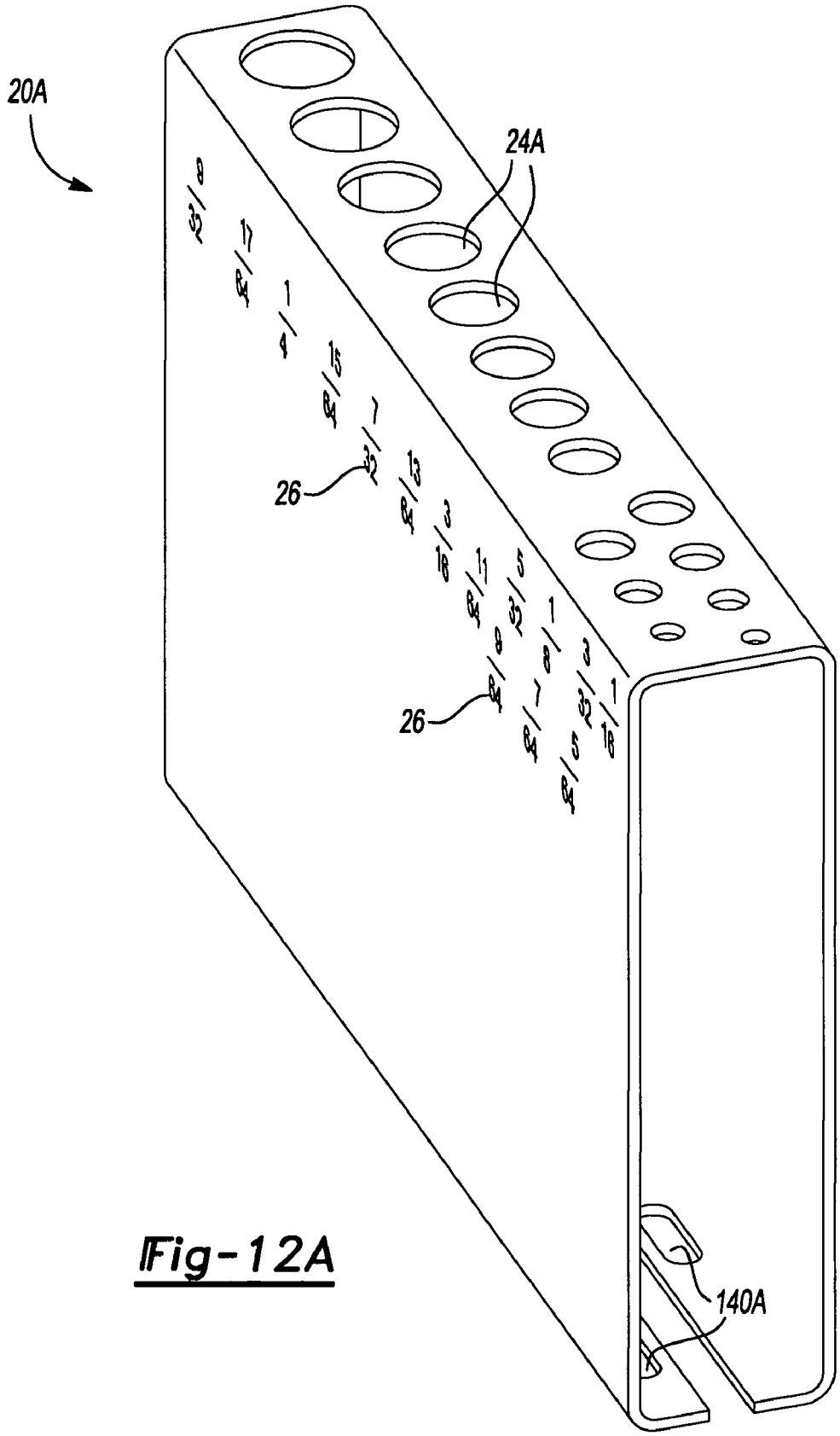
FIG. 12A is a perspective view of a third metal sleeve of the storage container.
Figure 12B:
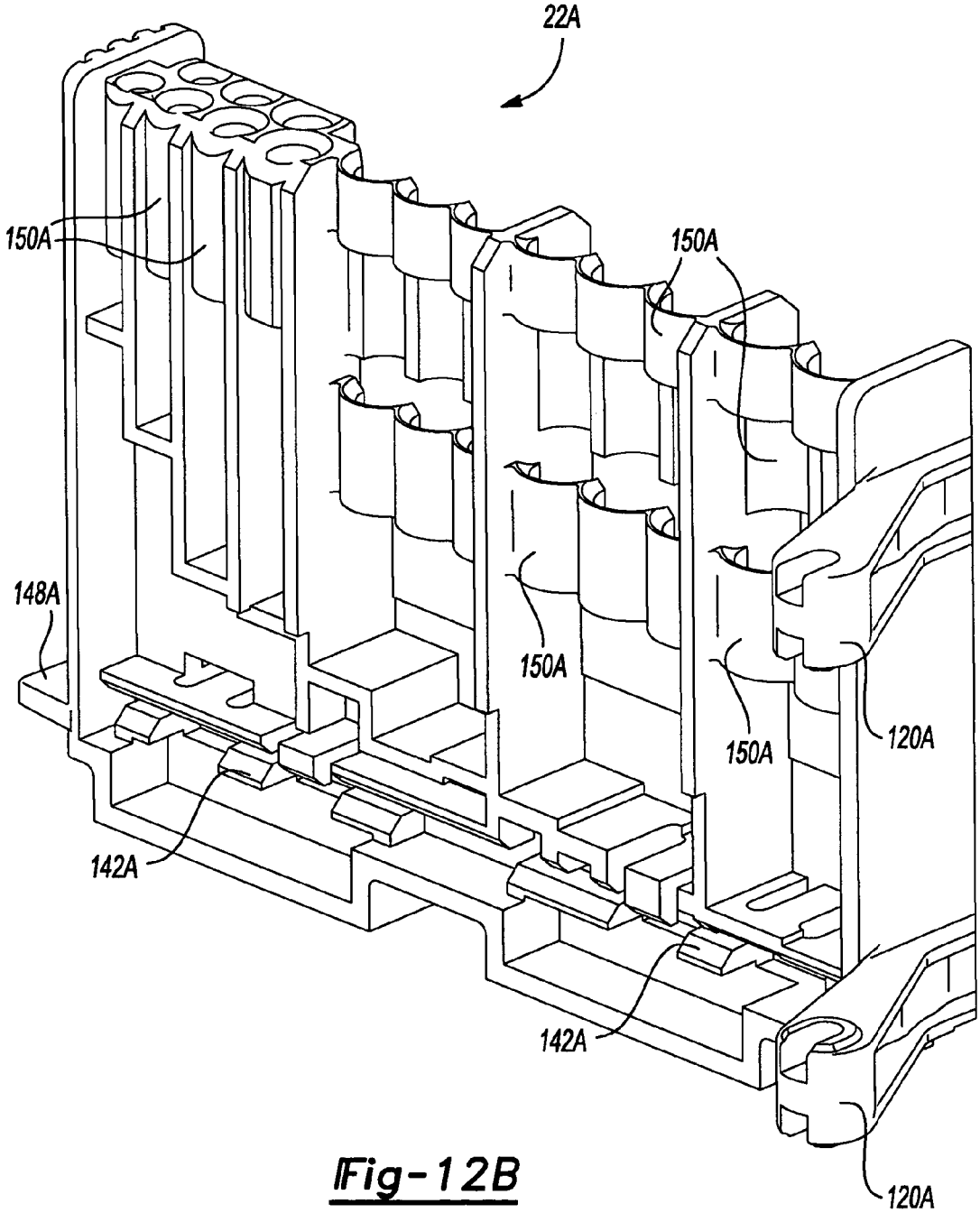
FIG. 12B is a perspective view of a third frame body portion of the storage container.
Figure 13A:
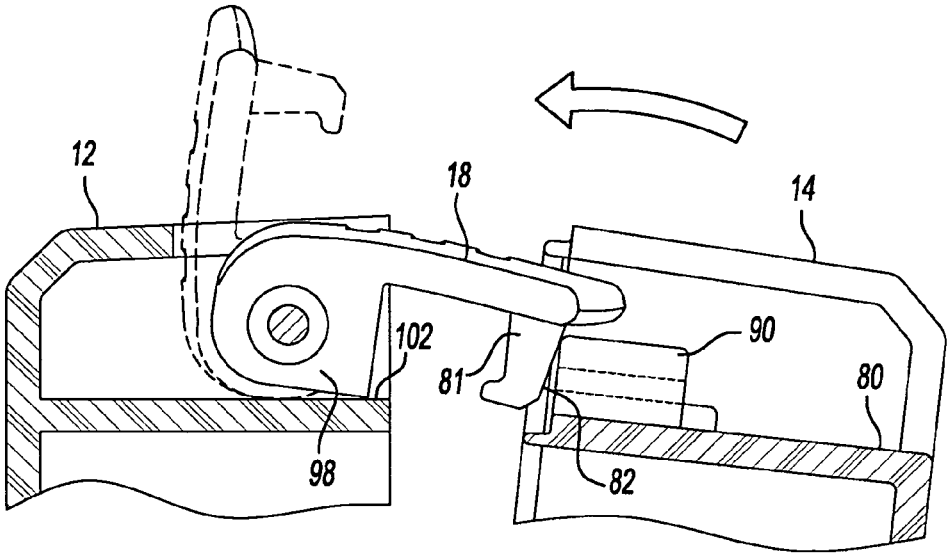
FIG. 13A is a partial cutaway view of the storage container illustrating a latch overextend prevention feature.
Figure 13B:
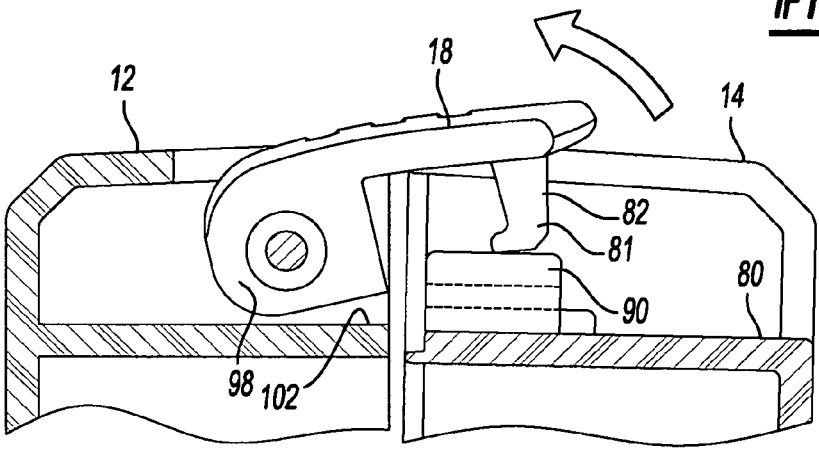
FIG. 13B is the cutaway view of FIG. 13A shown with the latch urged into an open position.
Figure 13C:
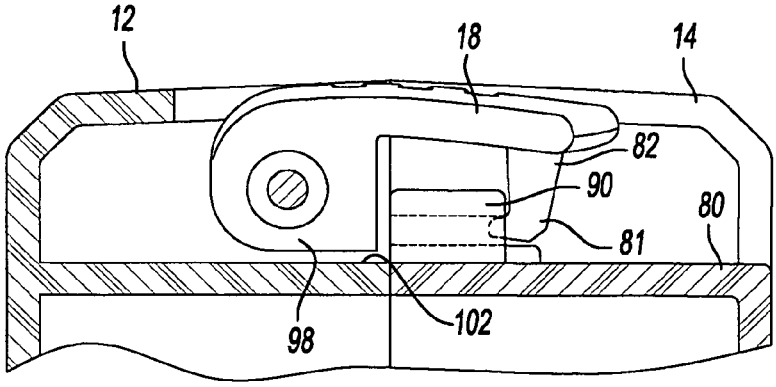
FIG. 13C is the cutaway view of FIG. 13B shown with the storage container in a locked position.

With initial reference to FIGS. 1 and 2, a bit container according to the present invention is illustrated and generally identified at reference 10. The container 10 includes a front clam shell housing portion 12 and a rear clam shell housing portion 14. The front clam shell housing portion 12 is connected to the rear clam shell housing portion 14 by a hinge pin 16 extending through hinge 17. A latch 18 is connected to the front housing 12 and pivots to an engaged position to engage the rear housing portion 14. With reference to FIGS. 8 and 9, three page-like bit holders 19A-19C are pivotally disposed within the container 10. The page-like bit holders 19A-19C generally include metal sleeves 20A-20C which are each received within corresponding frame body portions 22A-22C. The frame body portions 22A-22C are formed as part of the hinge 17. Each of the metal sleeves 20A-20C include apertures 24A-24C incorporated in the respective metal sleeves 20A-20C for receiving various sized drill bits. The apertures may be configured to accept metric or English unit drill bits, or both. Preferably, the apertures 24A-24C are arranged with increased diameter across each of the metal sleeves 20A-20C for convenience and ease of identification. In addition, drill bit size indicators 26 are etched on both sides of the metal sleeves 20A-20C (most clearly shown on FIGS. 8 and 9). The frame body portions 22A-22C are pivotal relative to the front and rear clam shell housing portions 12, 14 to allow the page-like bit holders 19A-19C to be flipped like pages relative to the housing portions 12, 14.

With continued reference to FIGS. 1 and 2 and further reference to FIGS. 4-7 and 9, the front housing portion 12 will be described in greater detail. The front housing portion 12 generally includes a front outer face 30 and a front inner face 32 having an optional viewing passage 36 incorporated therethrough. A diagonal strip 38 is disposed across the viewing passage 36 and incorporates a depth D (most clearly shown in FIG. 9) into an inner cavity of the container 10. The diagonal strip 38 is arranged to align with the tips of a series of drill bits 40A disposed in sleeve 20A. In this way, the diagonal strip 38 precludes axial movement of the drill bits 40A in sleeve 20A from sliding toward a top surface 44 of the front housing portion 12 while the container is in a closed position or while in an open position with sleeve 20A positioned against the front housing portion 12. Viewing passage 36 may comprise an aperture, an aperture having a transparent panel fitted thereon or alternately the front outer face 30 of the front housing portion 12 may be solid to prevent viewing or otherwise access therethrough.

Figure 4:
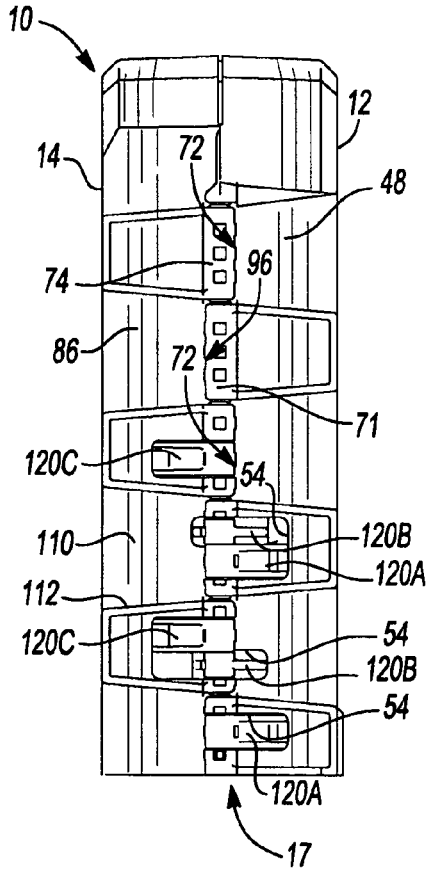
FIG. 4 is a left side view of the storage container illustrating the hinge connecting the front and rear clam shell housing portions.
Figure 5:
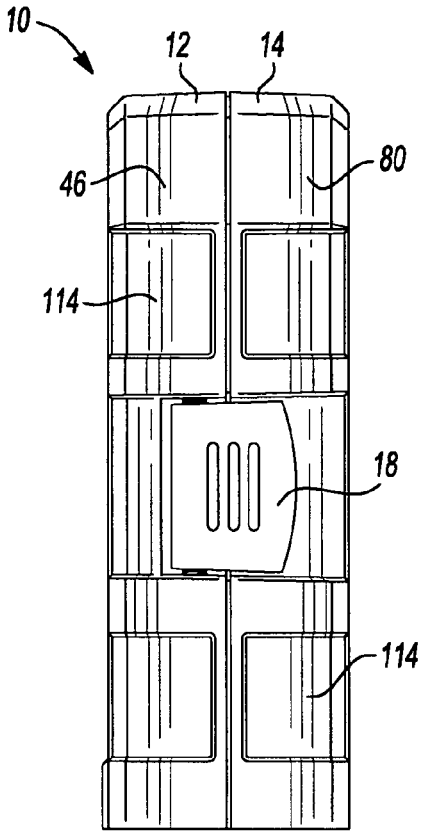
FIG. 5 is a right side view of the storage container illustrating the latch for releasably engaging the front and rear clam shell housing portions.
Figure 6:
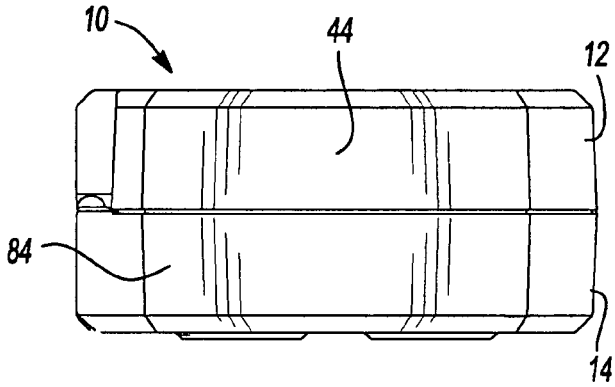
FIG. 6 is a top view of the storage container.
Figure 7:
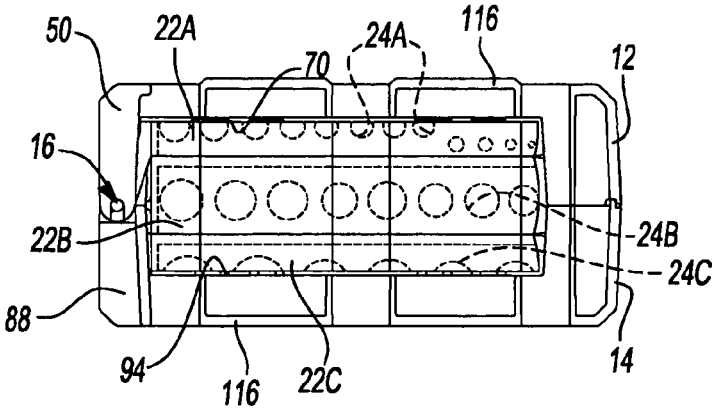
FIG. 7 is a bottom view of the storage container.

Front housing portion 12 is further defined by a peripheral side wall including a side latch face 46 (FIG. 5), a side hinge face 48 (FIG. 4), a bottom face 50 (FIG. 7) and the top surface 44. The side hinge face 48 (best illustrated in FIG. 4) includes cutouts 54 for accommodating hinge arms 60A-60C of the hinge 17, as will be described in greater detail. A groove 64 (best shown in FIG. 9) extends around an inner edge of the top surface 44 and the side hinge face 48 of the front housing portion 12 to cooperate with a complimentary lip 66 on the rear housing portion 14 in a closed position. The bottom face 50 of the front clam shell housing portion 12 incorporates an inset portion 70, as illustrated in FIGS. 7 and 9, for accommodating the frame body portions 22A-22C while in a closed position. A ledge 68 provides vertical support for the page-like bit holders 19A and 19B when the container 10 is in a closed position. With reference to FIG. 4, the side hinge face 48 of the front housing portion 12 includes hinge posts 71 separated by void portions 72 formed thereon for accommodating hinge posts 74 of the rear housing portion 14.

Figure 3:
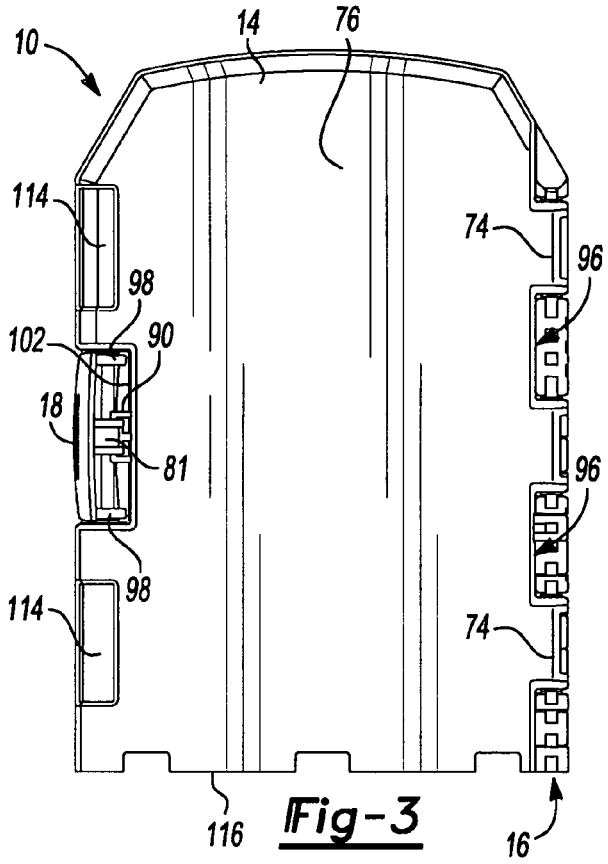
FIG. 3 is a plan view of the outer surface of the rear clam shell housing portion.

The rear clam shell housing portion 14 is defined by a peripheral side wall extending from a rear face 76 (FIG. 3). The peripheral side wall of the rear housing portion 14 includes a side latch face 80 (FIG. 5), a top face 84 (FIG. 6), a side hinge face 86 (FIG. 4) and a bottom face 88 (FIG. 7). The groove 66 (FIG. 9) is formed on an inner edge of the top face 84 and the side latch face 80 of the rear housing portion 14. Similar to the front housing portion 12, the bottom face 88 of the rear housing portion 14 incorporates an inset 94 (FIG. 7) for accommodating the frame body portions 22A-22C while in a closed position. A ledge 69 provides vertical support for the page-like bit holders 19B and 19C when the container 10 is in a closed position. The side hinge face 86 of the rear housing portion 14 includes void portions 96 disposed between the hinge posts 74 for accommodating the hinge posts 71 of the front housing portion 12.

With particular reference to FIGS. 3, 8, 9 and 13A-13C, the latch 18 will be described in greater detail. A catch 90 extends from the side latch face 80 for catching a tooth 81 (FIGS. 13A-13C) incorporated on an underside of the latch 18 in an engaged position. First and second shoulders 98 extend on opposite ends of the latch 18 and function to prevent the latch 18 from over-rotating in an inward direction when the container 10 is in an open position. Specifically the shoulders 98 abut a wall 102 (FIG. 13A) formed on the front body portion 12 to preclude the latch 18 from becoming trapped between the front and rear housing portions 12 and 14 when a user rotates the front and rear housing portions 12 and 14 from an open position to a closed position. As the user rotates the rear housing portion 14 toward the front housing portion 12, the surface to surface interaction of tooth 81 and the catch 90 influences the latch 18 counterclockwise as viewed from FIG. 13B. In particular, the front surface 82 of the tooth 81 is angled and/or otherwise configured so as to cause the tooth 81 to ride upward when contacted by the catch 90, thus causing the counterclockwise rotation of the latch 18. Once the front and the rear housing portion are touching (FIG. 13C), the tooth 81 of the latch 18 may be located into the locked position with the catch 90.

The front and rear housing portions 12, 14 are preferably comprised of hard plastic such as high impact ABS. As shown in the drawings (FIGS. 1 and 2), various inset and outset portions 110, 112 are incorporated on the side hinge faces 48, 86 of the front and rear housing portions 12, 14 for structural integrity. Furthermore, the inset portions 110 and the outset portions 112 are alternatively placed whereby an inset portion 110 of one of the front and rear housing portions 12, 14 accepts an outset portion 112 of the other front and rear housing portion in an open position. The side latch faces 46, 80 of the front and rear housing portions 12, 14 incorporate indentations 114 thereon, to improve structural integrity and robustness. The hinge pin 16 is preferably comprised of durable metal having a smooth surface such as zinc plated steel. In addition, the hinge pin 16 may be coated with a clear chromate surface.

Turning now to FIGS. 4 and 7-9, the metal sleeves 20A-20C will be described in greater detail. The metal sleeves 20A-20C are preferably arranged in increasing height from front to rear of the storage container 10. Likewise, a series of smaller drill bits 40A are received within the shorter front sleeve 20A while a series of larger drill bits 40C are received within the taller rear sleeve. This arrangement allows convenient viewing of the drill bits to properly identify the drill bit of interest. In addition, the hinged configuration of the metal sleeves 20A-20C allows a user to index freely through the page-like bit holders 19A-19C to gain adequate access to remove or insert a particular drill bit.

Each of the frame body portions 22A-22C includes a pair of laterally offset hinge arms 120A, 120B, and 120C, respectively so as to cooperatively interfit with the hinge 17 (see e.g. FIG. 4). Preferably one of the hinge arms 120A cooperate with the hinge 17 at an area proximate to the bottom face 50. Accordingly, the hinge arms 120B are offset toward the top face 44 a predetermined distance from hinge arms 120A and hinge arms 120C are offset toward the top face 44 a predetermined distance from hinge arms 120B. Such an alignment provides structural balance for the page-like bit holders 19A-19C consistent with the increasing height from the page-like bit holders 19A-19C. It is appreciated however that alternative hinge arrangements may be employed.

Each frame body portion 22A-22C incorporates a stepped surface 126A-126C thereon. The stepped arrangement provides increased structural integrity consistent with the aforementioned inset and outset portions 110 and 112 of the front and rear housing portion 10, 12. The side surfaces 130A-130C of each of the frame body portions 22A-22C include ridges 132A-132C formed therealong. The ridges 132A-132C provide an improved gripping surface to facilitate indexing through the page-like bit holders 19A-19C.

The storage container 10 incorporates a variety of surfaces that allow the storage container to free-stand thereon. Specifically, the outset portions 112 (see e.g. FIG. 2) arranged on the hinge faces 48 and 86 present a favorable side plane having a sufficient footprint to rest thereon. Furthermore, protruding sections 116 are formed on the front and rear housing portions 12 and 14 (see e.g. FIG. 1 and 3) and cooperate with the lower faces of the stepped surfaces 126A-126C incorporated on the bit holders 19A-19C to present a common plane of which the storage container may free-stand thereon (see e.g. FIG. 9). In this way, the protruding sections 114 and the lower faces of the stepped surfaces 126A-126C communicate with the common plane at a fully open position and a fully closed position and throughout all positions between providing a plurality of free standing conditions on the common plane.

With continued reference to FIG. 9 and further reference to FIGS. 10A-12C additional features of the page-like bit holders 19 will be described. Passages 140A-140C (FIGS. 10A, 11A and 12A) are incorporated in the metal sleeves 20A-20C for receiving complementary teeth 142A-142C disposed on the respective frame body portions 22A-22C in an engaged position (FIG. 9). The passages 140A-140C and complementary teeth 142A-142C provided on the metal sleeves 20A-20C and frame body portions 22A-22C are preferably configured to prohibit the metal sleeves from being placed backward or on the wrong frame body portion. In this way, the passages 140A-140C are distinctly spaced on each of the frame body portions 22A-22C and will only accommodate similarly spaced teeth 142A-142C on the respective metal sleeves 20A-20C.

Feet 148A-148C extend from each respective frame body portion 22A-22C in a lateral direction with respect to the ledges 68 and 69 of the front and rear housing portions 12 and 14. The foot 148A and a portion of the foot 148B overlap the ledge 68 when the page-like bit holders 19A and 19B are rotated against the front inner face 32 of the front housing portion 12. The ledge 68 disposed beneath the feet 148A-148B inhibits downward vertical deflection of the page-like bit holders 19A and 19B thereby enhancing structural robustness and reducing stress on the hinge arms 120A-120C in the event of dropping or otherwise jolting the container 10. Similarly, the ledge 69 of the rear housing portion 14 laterally supports the foot 148C and a portion of the foot 148B to inhibit downward vertical deflection of the page-like bit holders 19B and 19C. It should be understood that the overlapping feet of the frame body portions of the page-like bit holders do not need to extend laterally from the bit holders, but instead can be formed in any manner to cause a portion of the bit holders to simply overlap the ledges 68, 69.

Radial support members 150A-150C are formed along each of the frame body portions 22A-22C. The radial support members 150A-150C and the complementary apertures 24A-24C in the metal sleeves 20A-20C are collectively referred to as bit receiving portions. The radial support members 150A-150C facilitate smooth insertion and retraction of the drill bits 40A-40C by providing partial radial boundaries for the drill bits 40A-40C. As shown in the drawings, the radial support members 150B and 150C of the frame body portions 22B and 22C occupy a partial circumferential boundary of the apertures 24B and 24C. Preferably, complimentary radial support members 150A-150C are disposed at axially offset locations of the apertures and occupy an unbounded circumferential portion of the apertures. The axial offset of the radial support members 150A-150C on opposite sides of the frame body portions 22A-22C facilitate the molding of the frame body portions 22A-22C.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A storage container for housing bits, the storage container comprising:

a front housing portion and a rear housing portion pivotally connected through a hinge for moving between open and closed positions, said front housing portion and said rear housing portion defining a body cavity therebetween in said closed position;

a front bit holder pivotally connected to said hinge and disposed adjacent to said front housing portion in said closed position, said front bit holder extending upward a first distance from a bottom of said body cavity;

a rear bit holder pivotally connected to said hinge and disposed adjacent to said rear housing portion in said closed position, said rear bit holder extending upward a second distance from a bottom of said body cavity, said second distance being greater than said first distance; and an intermediate bit holder pivotally connected to said hinge and disposed between said front and rear bit holder.

2. The storage container of claim 1 wherein said intermediate bit holder extends upward from a bottom of said body cavity a third distance, said third distance being less than said second distance and greater than said first distance.

3. The storage container of claim 1 wherein said front, rear and intermediate bit holders are each further defined by a corresponding frame pivotally coupled at said hinge, each frame carrying a sleeve thereon, said sleeves each having a plurality of apertures arranged thereon adapted to accept the bits.

4. The storage container of claim 3 wherein said frames each include ridges incorporated on side faces thereof, said side faces facing lateral to and opposite said hinge.

5. The storage container of claim 3 wherein said sleeves are comprised of a metallic material.

6. The storage container of claim 5 wherein said frames are comprised of rigid plastic.

7. The storage container of claim 1, further comprising a retaining member extending from one of said first and second housing portions into said body cavity, said retaining member adapted to extend adjacent to predetermined bits of at least one of said front, rear and intermediate bit holders to preclude movement of said predetermined drill bits out of said bit holders while in said closed position.

8. The storage container of claim 5 wherein said retaining member extends at an angle with respect to a bottom of said body cavity to accommodate a series of said predetermined bits having increased height, said retaining member extending substantially parallel to tips of said series of bits.

9. A storage container for housing bits, the storage container comprising:

a front housing portion and a rear housing portion pivotally connected through a hinge for moving between open and closed positions, said front housing portion and said rear housing portion defining a body cavity therebetween in said closed position;

a front, middle, and rear bit holder pivotally connected to said hinge and arranged to fit within said body cavity in said closed position, said middle bit holder opposed to and located between said front and rear bit holders, said front, middle, and rear bit holders including bit receiving portions formed therein for accepting bits, each of said front, middle, and rear bit holders having a front side for facing said front housing portion and a rear side for facing said rear housing portion; and wherein said front bit holder extends upward a first distance from a bottom of said body cavity and said rear bit holder extends upward a second distance from said bottom of said body cavity, said second distance being greater than said first distance.

10. The storage container of claim 9 wherein said middle bit holder extends upward from a bottom of said body cavity a third distance, said third distance being less than said second distance and greater than said first distance.

11. The storage container of claim 9 wherein said front, rear and middle bit holders are each further defined by a corresponding frame pivotally coupled at said hinge, each frame carrying a sleeve thereon, said sleeves each having a plurality of apertures arranged thereon adapted to accept the bits.

12. The storage container of claim 11 wherein said frames each include ridges incorporated on side faces thereof, said side faces facing lateral to and opposite said hinge.

13. The storage container of claim 9, further comprising a retaining member extending from one of said first and second housing portions into said body cavity, said retaining member adapted to extend adjacent to predetermined bits of at least one of said front, rear and middle bit holders to preclude movement of said predetermined drill bits out of said bit holders while in said closed position.

14. The storage container of claim 13 wherein said retaining member extends at an angle with respect to a bottom of said body cavity to accommodate a series of said predetermined bits having increased height, said retaining member extending substantially parallel to the tips of said series of bits.

15. A storage container for housing bits, the storage container comprising:

a front housing portion and a rear housing portion pivotally connected through a hinge for moving between open and closed positions, said front housing portion and said rear housing portion defining a body cavity therebetween in said closed position; and a front, middle, and rear bit holder pivotally connected to said hinge and arranged to fit within said body cavity in said closed position, said middle bit holder opposed to and located between said front and rear bit holders, said front, middle and rear bit holders providing a stepped relationship wherein said front bit holder defines a first height relative to a bottom of said body cavity, said middle bit holder defines a second height relative to said bottom of said body cavity and said rear bit holder defines a third height relative to said bottom of said body cavity, said second height being greater than said first height and said third height being greater than said second height.

16. The storage container of claim 15 wherein said front, rear and middle bit holders are each further defined by a corresponding frame pivotally coupled at said hinge, each frame carrying a sleeve thereon, said sleeve having a plurally of apertures arranged thereon adapted to accept the bits.

17. The storage container of claim 16 wherein said frames each include ridges incorporated on side feces thereof, said side faces facing lateral to and opposite said hinge.

18. The storage container of claim 15, further comprising a retaining member extending from one of said first and second housing portions into said body cavity, said retaining member adapted to extend adjacent to predetermined bits of at least one of said front, rear and middle bit holders to preclude movement of said predetermined drill bits out of said bit holders while in said closed position.

* * * * *

UNITED STATES PATENT AND TRADEMARK OFFICE

CERTIFICATE OF CORRECTION

PATENT NO. : 7,331,456 B2
APPLICATION NO. : 11/507821
DATED : February 19, 2008
INVENTOR(S) : James E. Pangerc et al.

It is certified that error appears in the above-identified patent and that said Letters Patent is hereby corrected as shown below:

Title Page,
Item (12), "Pengerc et al." should be --Pangerc et al.--.

Title Page,
Item (75), Inventors, line 1, "Pengerc" should be --Pangerc--.

Column 6,
Line 65, "claim 5" should be --claim 7--.

Column 8,
Lines 30-31, "plurally" should be --plurality--.
Line 33, "feces" should be --faces--.

Signed and Sealed this

Third Day of March, 2009

John Doll

JOHN DOLL
*Acting Director of the United States Patent and Trademark Office*